US008408542B2

(12) United States Patent
Furihata et al.

(10) Patent No.: US 8,408,542 B2
(45) Date of Patent: Apr. 2, 2013

(54) MEDIA PROCESSING DEVICE

(75) Inventors: Hideki Furihata, Okaya (JP); Hironori Maekawa, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 20 days.

(21) Appl. No.: 13/050,861

(22) Filed: Mar. 17, 2011

(65) Prior Publication Data

US 2011/0225891 A1 Sep. 22, 2011

(30) Foreign Application Priority Data

Mar. 18, 2010 (JP) ..... 2010-062080

(51) Int. Cl.
*B65H 5/02* (2006.01)

(52) U.S. Cl. ..... 271/273; 271/257; 49/394

(58) Field of Classification Search ..... 49/381, 49/394; 271/257, 273
See application file for complete search history.

(56) References Cited

U.S. PATENT DOCUMENTS 4,360,279 A * 11/1982 Sugiura ..... 400/600.2
5,030,024 A * 7/1991 Seshimo ..... 400/605
6,510,301 B2 * 1/2003 Tanaka ..... 399/125
2007/0023255 A1 * 2/2007 Nunn et al. ..... 194/206
2007/0267808 A1 * 11/2007 Cha et al. ..... 271/273

FOREIGN PATENT DOCUMENTS

JP 2001-354334 A 12/2001
JP 2007-015749 A 1/2007

* cited by examiner

*Primary Examiner* — Michael McCullough
*Assistant Examiner* — Howard Sanders
(74) *Attorney, Agent, or Firm* — Kilpatrick Townsend & Stockton LLP

(57) ABSTRACT

A media processing device enables opening an openable unit so that the media transportation path is open with a minimal operation and little operating force. The media processing device has an openable unit that can rotate on a first pivot axis CL1 from a closed position to an open position; a lock member that can move to a locked position where it locks the openable unit in the closed position and an unlocked position where the lock is released; and an operating lever that can rotate on a second pivot axis CL2 through a range from a first pivot position passed a second pivot position to a third pivot position. A first cam mechanism converts rotation of the operating lever from the second pivot position to the third pivot position to rotation of the openable unit from the closed position to the open position.

6 Claims, 7 Drawing Sheets

MEDIA PROCESSING DEVICE

This application claims priority to Japanese Patent Application No. 2010-062080, filed Mar. 18, 2010, the entirety of which is incorporated by reference herein.

BACKGROUND

1. Technical Field

The present invention relates to a media processing device that processes recording media such as checks.

2. Related Art

Media processing devices that can both read a MICR line of magnetic ink characters printed on a check or similar recording medium, and print on the recording medium, are known from the literature. The media processing device described in Japanese Unexamined Patent Appl. Pub. JP-A-2000-43339, for example, has a main unit, a reader/printer unit, and a roll paper unit. The reader/printer unit includes magnetic head for reading magnetic ink characters, and a print unit for printing on recording media. A media transportation path is rendered in this media processing device between the main unit and the reader/printer unit passing the magnetic ink character reading position and the printing position, and recording media are conveyed through this media transportation path.

The reader/printer unit in this media processing device can be opened in order to open the media transportation path so that recording media jammed in the media transportation path can be removed and for maintenance of the reader/printer unit, for example. In order to open the media transportation path, a configuration that enables swinging the reader/printer unit on a defined pivot axis between a closed position in which the media transportation path is defined and an open position in which the media transportation path is open and accessible. A lock mechanism is provided for locking the reader/printer unit in the closed position. A handle is disposed to the unit cover, for example, for releasing the lock and swinging the reader/printer unit to the open position.

When the handle attached to the reader/printer unit is lifted by hand to open the reader/printer unit from the closed position to the open position, the weight of the reader/printer unit bears directly on the operator's hand, and significant strength may be required if the reader/printer unit is heavy. When components such as a printhead and transportation rollers are disposed to the reader/printer unit of the media processing device, the reader/printer unit is heavy compared with the access cover provided on most printers, and significant force is therefore needed to open the reader/printer unit.

Opening the reader/printer unit wide is also desirable to facilitate removing recording media stuck in the media transportation path. This means that the operator must hold the handle of the reader/printer unit and swing the reader/printer unit through a large radius to the open position. Lifting a heavy reader/printer unit to a wide opening is not easy for someone that is weak. Furthermore, in order for the operator to lift the reader/printer unit up to a wide opening, a large space is required around the media processing device for the reader/printer unit to be lifted and pivoted open by hand. In addition, when the media processing device is installed in a confined space, moving the media processing device to a different location may be necessary in order to open the reader/printer unit. This is inconvenient for the operator.

SUMMARY

A media processing device enables easily opening an openable unit on which a printhead and other parts are mounted to open and provide free access to the media transportation path with a minimal range of operation and little operating force.

A first aspect of the invention is a media processing device including: a main frame; an openable unit that is attached to the main frame pivotably on a first pivot axis through a range from a closed position to an open position; a media transportation path that is formed between the openable unit in the closed position and the main frame for conveying a recording medium, and becomes open when the openable unit opens toward the open position; a lock member that is attached to the main frame movably between a locked position where it locks the openable unit in the closed position, and an unlocked position where the lock is released; an operating lever that can rotate relative to the main frame on a second pivot axis that is parallel to the first pivot axis at a different position than the first pivot axis through a range from a first pivot position through a second pivot position to a third pivot position; and a first cam mechanism that is disposed between the operating lever and the openable unit, converts rotation of the operating lever from the second pivot position to the third pivot position to rotation of the openable unit from the closed position to the open position, and converts rotation of the operating lever from the third pivot position to the second pivot position to rotation of the openable unit from the open position to the closed position.

In another aspect of the invention, the media processing device preferably also has a second cam mechanism that is disposed between the operating lever and the lock member, converts rotation of the operating lever from the first pivot position to the second pivot position to movement of the lock member from the locked position to the unlocked position, and converts rotation of the operating lever from the second pivot position to the first pivot position to movement of the lock member from the unlocked position to the locked position.

In a media processing device according to the invention the first pivot axis that is the pivot axis of the openable unit, and the second pivot axis that is the pivot axis of the operating lever, are located at different positions, and the openable unit and the operating lever move along different arcs. Because the cam surface and cam follower of the first cam mechanism disposed between these pivot axes therefore also rotate on different arcs, the opening angle (rotation) of the openable unit can be made greater than the operating angle (rotation) of the operating lever by appropriately configuring the cam surface and cam follower. The openable unit can therefore be opened wide with a small operation of the operating lever.

Furthermore, by rendering the distance from the first pivot axis to the operating end of the operating lever greater than the distance from the first pivot axis to the first cam mechanism in the media processing device according to the invention, the openable unit can be opened with little force compared to opening an openable unit by lifting directly on a handle attached to the openable unit.

With this aspect of the invention, while the operating lever rotates from the first pivot position to the second pivot position, that is, until the lock member is released from the locked position, the openable unit does not open, and the weight of the openable unit therefore does not work on the operating lever. Because the weight of the openable unit and the counter force of the lock member therefore do not work on the operating lever at the same time, a large operating force is not required. The lock can therefore be released and the openable unit can be opened sequentially and continuously by operating the operating lever, and the operability of the operating lever is good.

The first cam mechanism for converting rotation of the operating lever from the second pivot position to the third pivot position to rotation of the openable unit from the closed position to the open position can be configured as follows.

In this aspect of the invention the first cam mechanism has a cam channel formed in the operating lever, and a slide pin that can slide in the cam channel and is attached to the openable unit, and the cam channel has a first cam channel part that extends in the direction of an arc centered on the second pivot axis, and a second cam channel part that curves and extends to the outside radially to the arc from the end of the first cam channel part in the closing direction of the openable unit. While the operating lever rotates from the first pivot position to the second pivot position, the slide pin slides relatively along the first cam channel part and the openable unit is held in the closed position. When the operating lever rotates from the second pivot position to the third pivot position, the slide pin slides along the second cam channel part and rotates around the first pivot axis, and the openable unit rotates to the open position.

In another aspect of the invention, the following configuration can be used as a second cam mechanism that converts rotation of the operating lever from the first pivot position to the second pivot position to movement of the lock member from the locked position to the unlocked position.

More specifically, the second cam mechanism includes a cam surface formed on the operating lever, and a pin attached to the lock member. While the operating lever rotates from the first pivot position to the second pivot position, the pin is pushed in the direction moving the lock member to the unlocked position while sliding along the cam surface.

When the media processing device has both the first cam mechanism and the second cam mechanism, the distance from the second pivot axis to the operating end of the operating lever is longer than the distance from the second pivot axis to the cam channel, and longer than the distance from the second pivot axis to the cam surface. This aspect of the invention enables using the principle of a lever to operate the operating lever with a small operating force to move the lock member to the unlocked position and open and close the openable unit.

Effect of the Invention

In a media processing device according to the invention, the operating lever and openable unit are pivoted on different axes of rotation, rotation of the operating lever from a first pivot position to a second pivot position is converted through an intervening second cam mechanism to movement of the lock member to the unlocked position, and rotation of the operating lever from the second pivot position to the third pivot position is converted through a first cam mechanism to rotation of the openable unit from the closed position to the open position.

Because the pivot path of the operating lever and the pivot path of the openable unit are different, the opening/closing angle of the openable unit can be increased relative to the operating angle of the operating lever by appropriately configuring the relative positions and shapes of the cam surface and cam follower of the first cam mechanism. In addition, if the distance from the pivot axis of the operating lever to the operating end of the operating lever is sufficiently longer than the distance from the pivot axis to the first cam mechanism and second cam mechanism, the lock member can be moved with little effort to the unlocked position and the openable unit can be opened and closed with a small operating force.

Other objects and attainments together with a fuller understanding of the invention will become apparent and appreciated by referring to the following description and claims taken in conjunction with the accompanying drawings.

DESCRIPTION OF EMBODIMENTS

A check processing device according to a preferred embodiment of a media processing device according to the present invention is described below with reference to the accompanying figures.

General Configuration of a Check Processing Device

Figure 1:
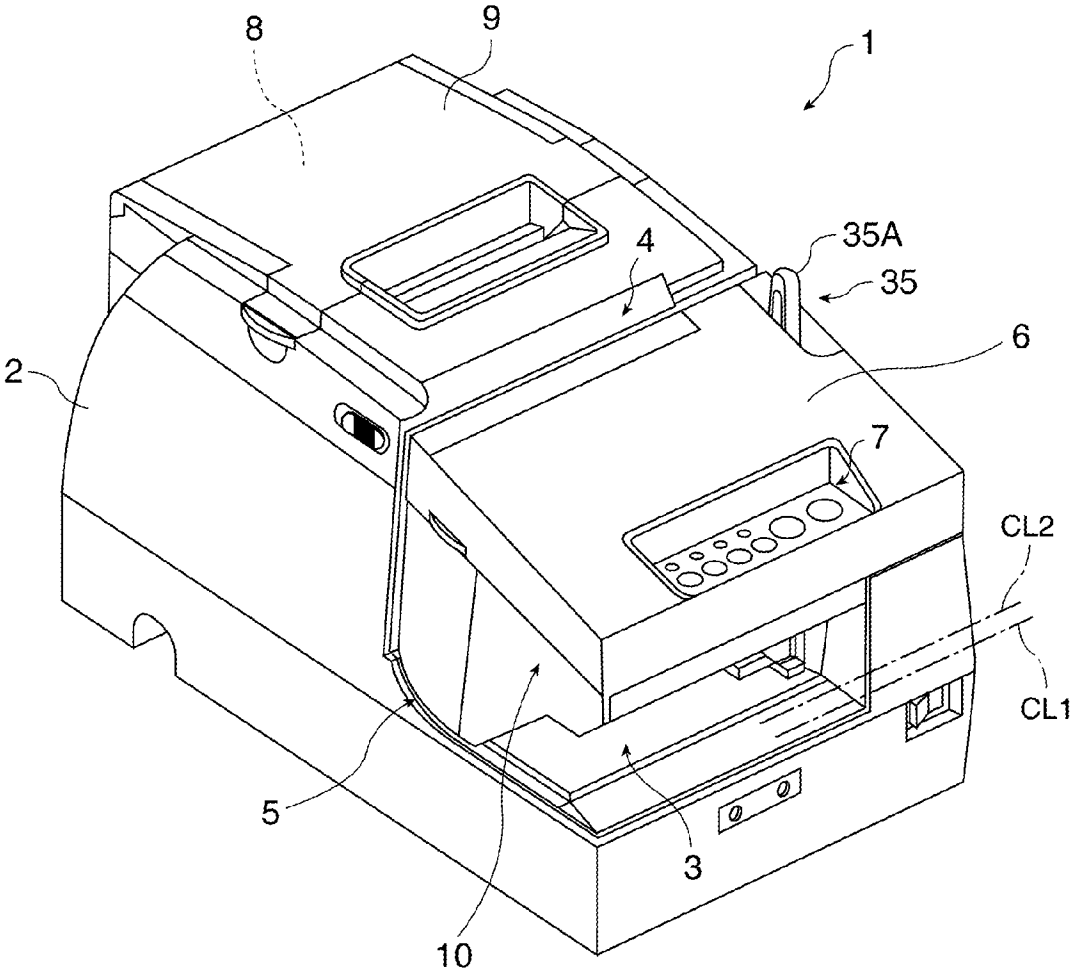
FIG. 1 is an external oblique view of a check processing device according to a preferred embodiment of the invention.
Figure 2B:
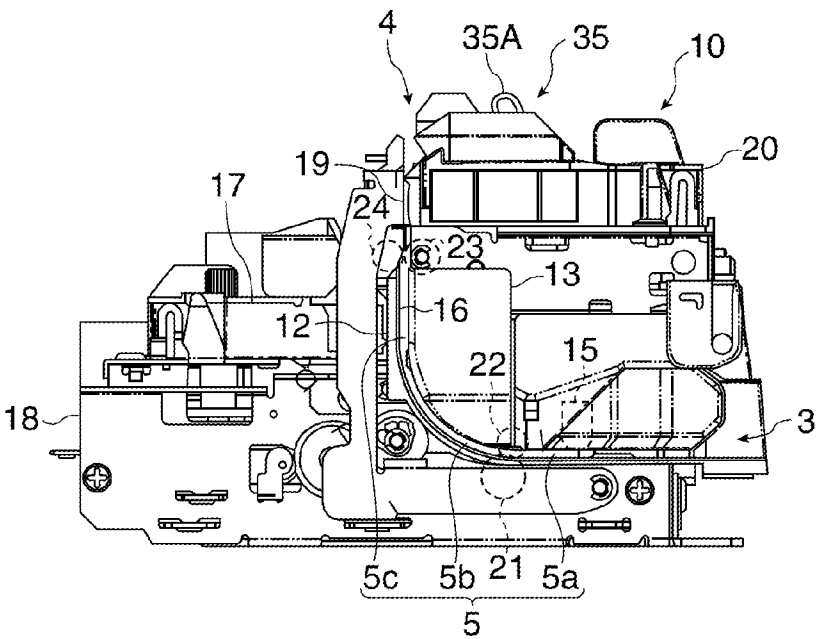
FIG. 2A is an oblique view and FIG. 2B is a side view showing the internal mechanical assembly of the check processing device.
Figure 2A:
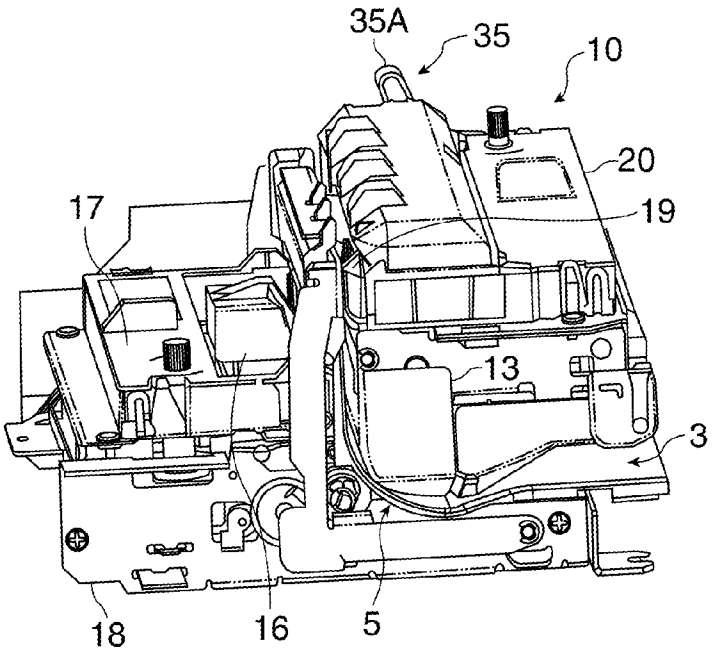

FIG. 1 is an external oblique view of a check processing device, and FIG. 2A and FIG. 2B are oblique and side views, respectively, showing the internal mechanism of the check processing device 1 with the outside case 2 removed.

As shown in FIG. 1, the check processing device 1 has a basically rectangular box-like outside case 2. A media insertion opening 3 for inserting a check (not shown in the figure) as a recording medium is disposed with a specific width widthwise to the printer on the front left side of the outside case 2.

A media exit 4 from which the processed checks are discharged is disposed with a specific width widthwise to the printer in the top of the outside case 2 in the middle between the front and back of the printer.

A media transportation path 5 through which the checks are conveyed is formed between the media insertion opening 3 and the media exit 4. The media transportation path 5 extends from the media insertion opening 3 toward the back of the printer and then curves and extends to the top. The media transportation path 5 is also open to the left side of the outside case 2.

In this embodiment of the invention the side of the width of the check processing device 1 on which the media insertion opening 3 is rendered is referred to as the left side, and the side in the front-back direction of the check processing device 1 to which the media insertion opening 3 opens is referred to as the front.

The top of the outside case 2 in front of the media exit 4 is covered by a front cover 6. An operating panel 7 is disposed at the front of the front cover 6. A compartment 8 is disposed and a cover 9 for opening and closing the compartment 8 is attached at the back of the top of the outside case 2. The cover 9 is pivotably attached at the back end thereof to the outside case 2.

The part of the check processing device 1 covered by the front cover 6 is an openable unit 10. The openable unit 10 can open forward pivoting on a first pivot axis CL1 that extends widthwise to the printer at the front bottom part of the openable unit 10. Opening the openable unit 10 opens the media transportation path 5 rendered between the openable unit 10 and the printer assembly.

An operating lever 35 of which the operating end 35A is exposed is disposed at the top right part of the openable unit 10. The openable unit 10 can be opened forward by manually pulling the operating lever 35 forward. This operating lever 35 pivots on a second pivot axis CL2 extending widthwise to the check processing device 1 at a different position than the first pivot axis CL1. The openable unit 10 and operating lever 35 are described in further detail below.

As shown in FIG. 2A and FIG. 2B, the media transportation path 5 includes a first transportation path part 5*a* that extends from the media insertion opening 3 towards the back of the device, a curved transportation path part 5*b* that curves upward from the back end of the first transportation path part 5*a*, and a second transportation path part 5*c* that extends upward from the top end of the curved transportation path part 5*b*.

The bottom of the first transportation path part 5*a* and curved transportation path part 5*b*, and the surface on the back side of second transportation path part 5*c* are defined by a conveyance guide 12. The top of the curved transportation path part 5*b* and the surface to the front of the second transportation path part 5*c* are defined by another conveyance guide 13.

A magnetic head 15 used to read the magnetic ink characters that are printed on checks is disposed to the first transportation path part 5*a*. The magnetic head 15 is disposed on the top side of the first transportation path part 5*a* with the magnetic gap facing down.

The first printhead 16 for printing on the back side of checks is disposed at the bottom side of the second transportation path part 5*c*. The first printhead 16 is a serial impact dot matrix (SIDM) printhead that prints by driving recording wires against an ink ribbon to transfer ink from the ink ribbon onto the check. The first printhead 16 is disposed to a first printhead unit 17 located on the back side of the second transportation path part 5*c*. The first printhead unit 17 is supported movably between the front and back of the check processing device 1 on the main frame 18.

A second printhead 19 that prints on the front of checks is disposed to the top end part of the second transportation path part 5*c*. Like the first printhead 16, the second printhead 19 is a SIDM printhead, and is carried on a second printhead unit 20 located in front of the second transportation path part 5*c*.

A pair of transportation rollers 21, 22 that convey checks passed the reading position of the magnetic head 15 is disposed at the junction between the first transportation path part 5*a* and curved transportation path part 5*b*. Another pair of transportation rollers 23, 24 that conveys checks to the second printhead 19 are disposed at the top end part of the second transportation path part 5*c* below the second printhead 19.

Configuration of the Openable Unit, Operating Lever, and Lock Lever

Figure 3:
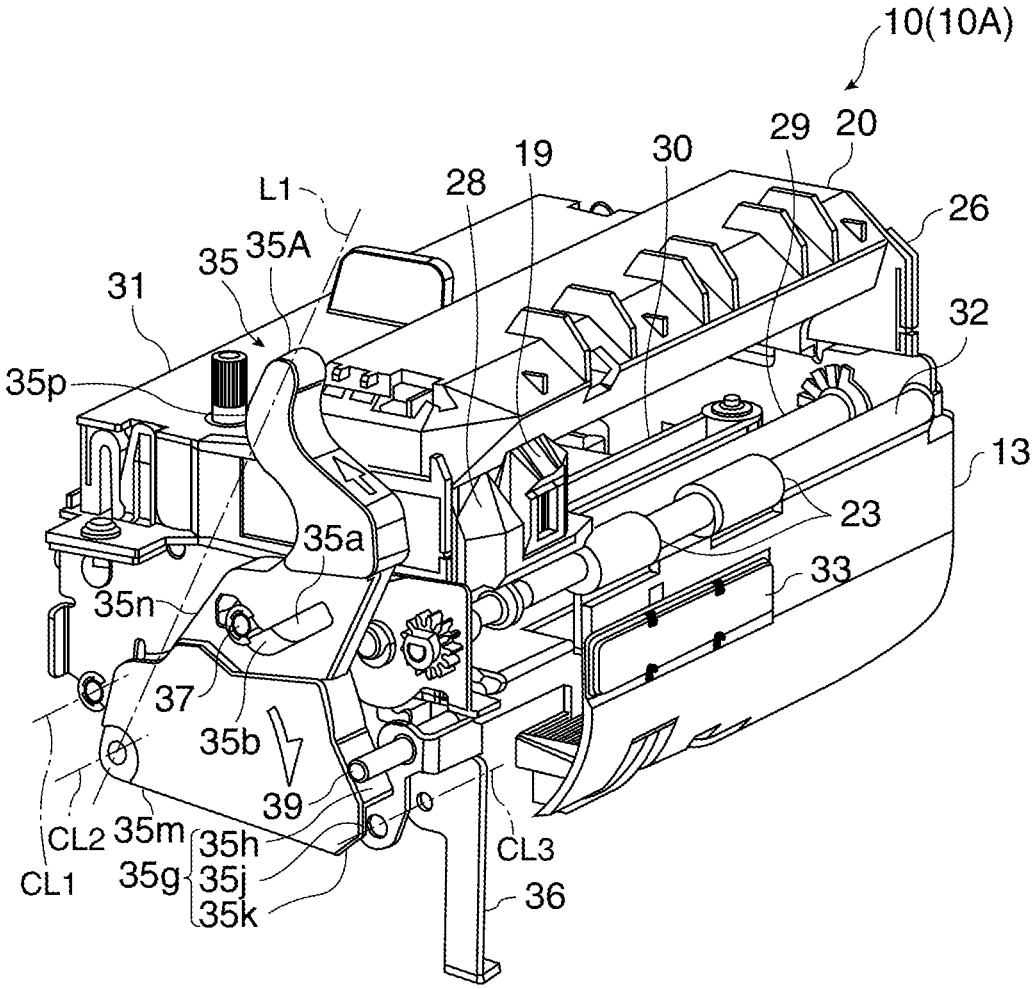
FIG. 3 is an oblique view from the right rear side of the openable unit in the closed position.
Figure 4:
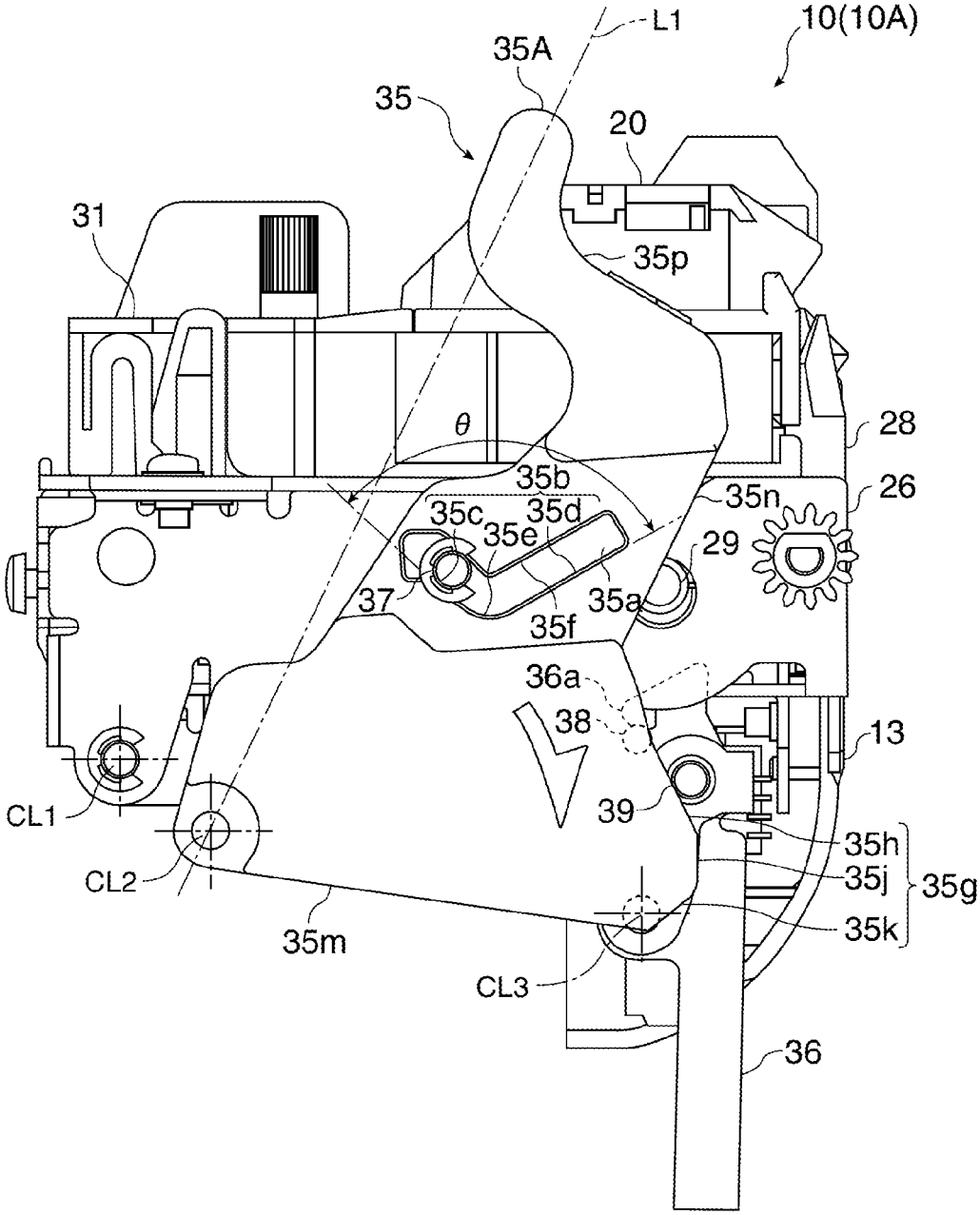
FIG. 4 is a right side view of the openable unit in the closed position.
Figure 5:
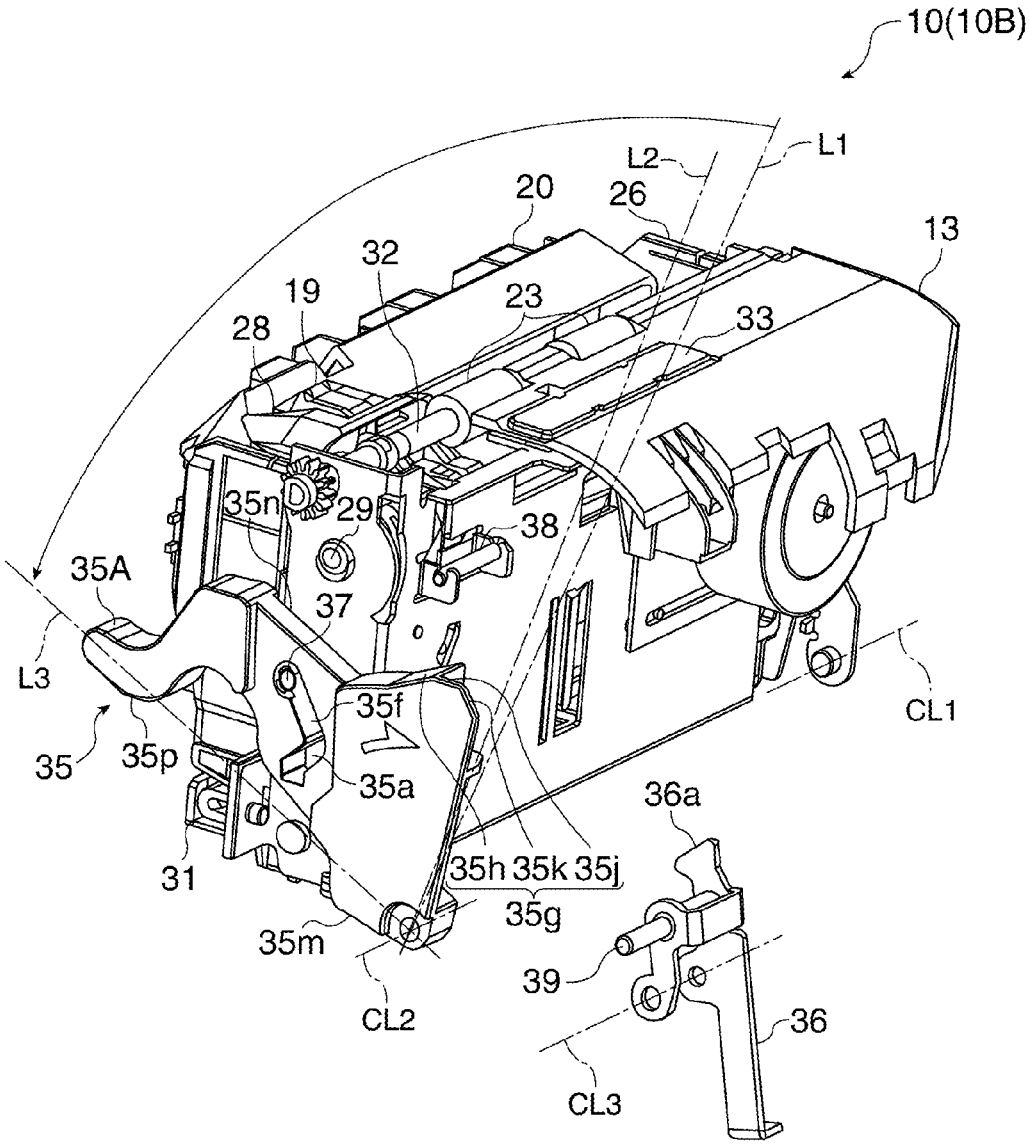
FIG. 5 is an oblique view from the right rear side of the openable unit in the open position.

FIG. 3 is an oblique view of the openable unit 10 in the closed position together with the operating lever 35 and lock lever 36 from the right rear side of the device. FIG. 4 is a right side view of the openable unit 10 in the closed position. FIG. 5 is an oblique view of the openable unit 10 in the open position together with the operating lever 35 and lock lever 36 from the right rear side of the device.

The second printhead unit 20 includes a head unit frame 26 that is pivotably supported on the main frame 18. The head unit frame 26 can rotate on an axis extending widthwise to the device. The pivot axis (first pivot axis) CL1 of the head unit frame 26 to the main frame 18 is at the front bottom end side of the head unit frame 26. A guide shaft 29 that guides the carriage 28 carrying the second printhead 19 transversely is disposed to the head unit frame 26 with its axis aligned with the device width. A carriage transportation mechanism including a timing belt 30 and motor for moving the carriage 28 reciprocally along the guide shaft 29 is disposed in front of the guide shaft 29 of the head unit frame 26. An ink ribbon cartridge 31 storing an ink ribbon is set on top of the head unit frame 26.

A rotating shaft 32 to which the transportation rollers 23 noted above are affixed is rotatably disposed behind the guide shaft 29 of the head unit frame 26. The foregoing conveyance guide 13 is fixed below the rotating shaft 32 of the head unit frame 26. A platen 33 opposing the first printhead 16 is fixed to the conveyance guide 13.

As described above, the head unit frame 26 can rotate on the first pivot axis CL1 relative to the main frame 18. More specifically, the second printhead unit 20 to which the conveyance guide 13 and transportation rollers 23 are disposed can rotate on the first pivot axis CL1 relative to the main frame 18.

The openable unit 10 includes the conveyance guide 13, transportation rollers 23, second printhead unit 20, and case (not shown in the figure) that covers the second printhead unit 20. The openable unit 10 can rotate on the main frame 18 between a closed position 10A (shown in FIG. 3 and FIG. 4) where the conveyance guide 13 is opposite the conveyance guide 12 and forms part of the media transportation path 5, and an open position 10B (shown in FIG. 5) where the curved transportation path part 5*b* and second transportation path part 5*c* where the conveyance guide 13 is disposed are open (thereby exposing the check transportation path of the curved transportation path part 5*b* and second transportation path part 5*c*).

The check processing device 1 has an operating lever 35 for rotating the openable unit 10, and a lock lever 36 as an example of a locking member that locks the openable unit 10 in the closed position 10A. The operating lever 35 and lock lever 36 are disposed on the right side of the check processing device 1.

The operating lever 35 is disposed along the right outside surface of the head unit frame 26. The operating lever 35 is pivotably supported on the main frame 18. The operating lever 35 can pivot on an axis of rotation transverse to the check processing device 1, and the front bottom end side of the operating lever 35 is the rotational axis (second pivot axis) CL2 of the operating lever 35 to the main frame 18. The second pivot axis CL2 is slightly behind the first pivot axis CL1, and slightly below the first pivot axis CL1.

As will be understood from FIG. 4, the bottom end of the operating lever 35 is bottom edge 35*m*, which is long in the front-back direction. A diagonal arm part 35*n* that is shorter than the bottom edge 35*m* in the front-back direction is formed extending from the top of the bottom edge 35*m* upward and slightly to the back. From the diagonal arm part 35*n* to the end of the distal end part 35*p*, the distal end part 35*p* gradually becomes narrower along its length in the front-back direction. The top end part of the distal end part 35*p* is the operating end 35A that is worked by the operator, and this operating end 35A protrudes above the top of the outside case 2. The operator of the check processing device 1 works the operating end 35A of the operating lever 35 to move the operating lever 35 rotationally.

A cam channel 35*a* of a substantially constant width is formed in and passing sideways through the operating lever 35 at a printing position approximately in the front-back center of the operating lever 35. The cam channel 35*a* extends diagonally upward to the back of the second pivot axis CL2. As seen in FIG. 4, the bottom inside surface of the cam channel 35*a* is a first cam surface 35*b* that causes the openable unit 10 to rotate. The top inside surface of the cam channel 35*a* is an opposing cam surface 35*f* that opposes the first cam surface 35*b*. A slide pin 37 affixed to the right side of the head unit frame 26 is slidably engaged in the cam channel 35*a*. The cam channel 35*a* and slide pin 37 thus render a first cam mechanism. The slide pin 37 functions as a cam follower that moves relative to the operating lever 35 along the cam channel 35*a* that is, along the first cam surface 35*b* and opposing cam surface 35*f*.

As shown in FIG. 4, the first cam surface 35*b* includes a first slope 35*c* that descends toward the back, a second slope 35*d* that ascends toward the back, and a curved part 35*e* that connects the first slope 35*c* and second slope 35*d*. The angle between the first slope 35*c* and second slope 35*d* is, for example, approximately 80° to 100°. When seen from the side, the first slope 35*c* extends along an arc centered on the second pivot axis CL2 or a tangent to the arc. The second slope 35*d* extends in a straight line curving radially to the outside from the arc. The opposing cam surface 35*f* includes a slope substantially parallel to the first slope 35*c*, and a slope substantially parallel to the second slope 35*d*. The first slope 35*c* and the slope of the opposing cam surface 35*f* substantially parallel to the first slope 35*c* render a first cam channel part, and the second slope 35*d* and the slope of the opposing cam surface 35*f* substantially parallel to the second slope 35*d* render a second cam channel part.

A second cam surface 35*g* for unlocking the lock lever 36 from the openable unit 10 is formed on the back bottom side of the operating lever 35 as seen in FIG. 4. The distance from the second pivot axis CL2 to the second cam surface 35*g* is shorter than the distance from the second pivot axis CL2 to the operating end 35A of the operating lever 35.

The second cam surface 35*g* includes a third slope 35*h*, fourth slope 35*j*, and fifth slope 35*k*. The third slope 35*h* descends toward the back. The slope of the third slope 35*h* is greater than the slope of the first slope 35*c* of the first cam surface 35*b*. The fourth slope 35*j* continues from the bottom end of the third slope 35*h*. The fourth slope 35*j* descends toward the back at a steeper angle than the third slope 35*h*. The fifth slope 35*k* continues from the bottom end of the fourth slope 35*j*. The fifth slope 35*k* descends the front.

The lock lever 36 is on the right side of the conveyance guide 13 when the openable unit 10 is in the closed position 10A. The lock lever 36 is on the left side of the operating lever 35. The lock lever 36 is pivotably supported on the main frame 18. The lock lever 36 pivots on an axis extending widthwise. The pivot axis (third pivot axis) CL3 of the lock lever 36 to the main frame 18 passes substantially through the center of the vertical length of the lock lever 36. The third pivot axis CL3 is slightly lower than the second pivot axis CL2.

An engaging part 36*a* that engages a lock pin 38 (see FIG. 5) fixed to the bottom of the head unit frame 26 with the axis extending widthwise is formed at the top end of the lock lever 36. The engaging part 36*a* is formed above the third pivot axis CL3. A contact pin 39 that contacts the second cam surface 35*g* is fixed with the axis extending widthwise at a position vertically between the engaging part 36*a* and the third pivot axis CL3. The contact pin 39 is positioned slightly behind the third pivot axis CL3 in the front-back direction. The second cam surface 35*g* and contact pin 39 render a second cam mechanism. The contact pin 39 functions as a cam follower that moves relative to the operating lever 35 along the second cam surface 35*g*. The lock lever 36 is urged counterclockwise as seen in FIG. 4 by an urging member (not shown in the figure) such as a coil spring.

Opening and Closing the Openable Unit

Figure 6B:
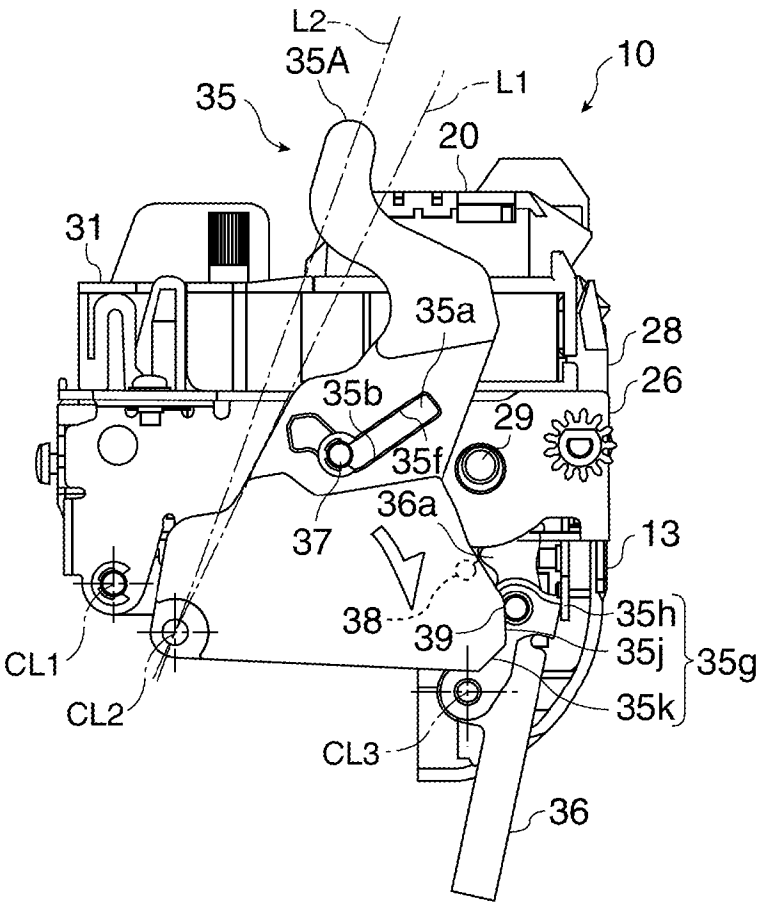
FIG. 6B illustrates opening the openable unit.
Figure 6A:
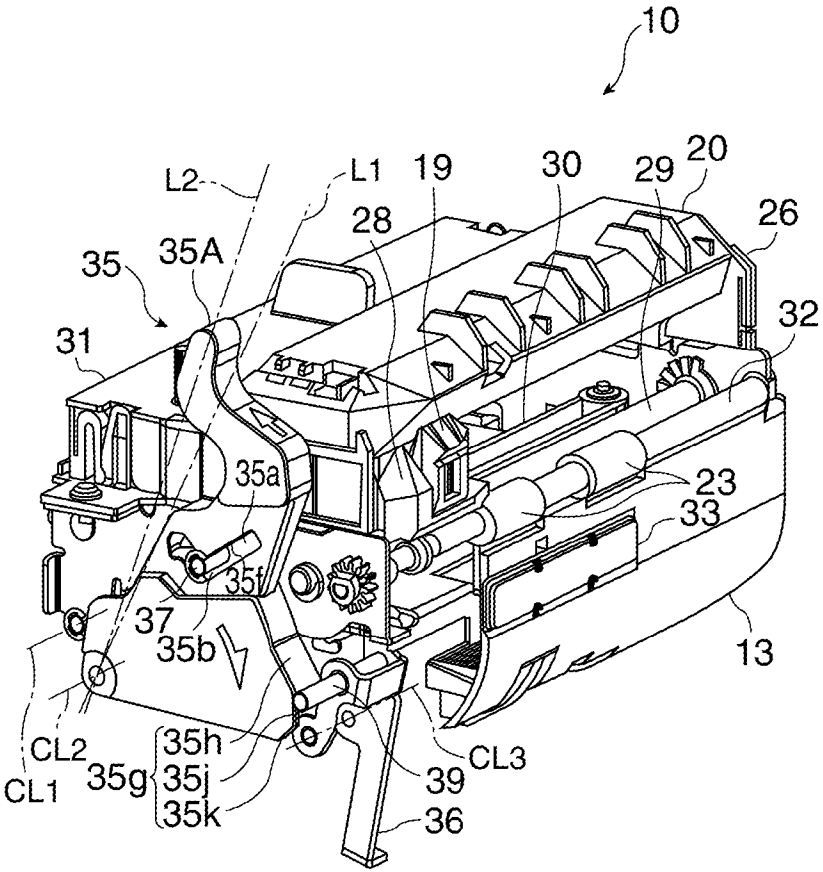
FIG. 6A illustrates opening the openable unit.
Figure 7B:
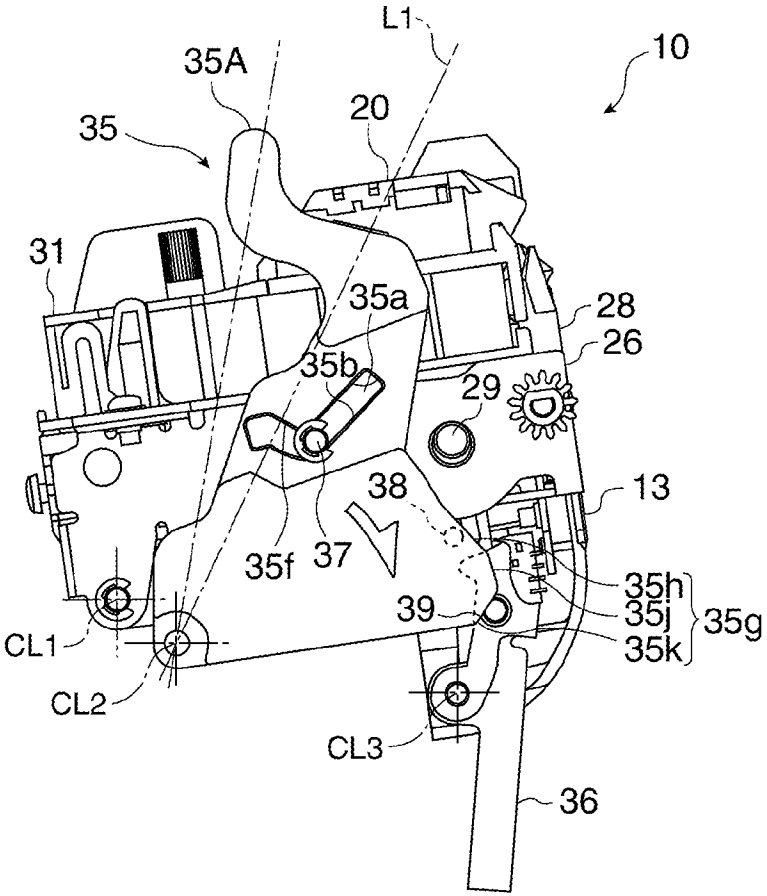
FIG. 7B illustrates opening the openable unit.
Figure 7A:
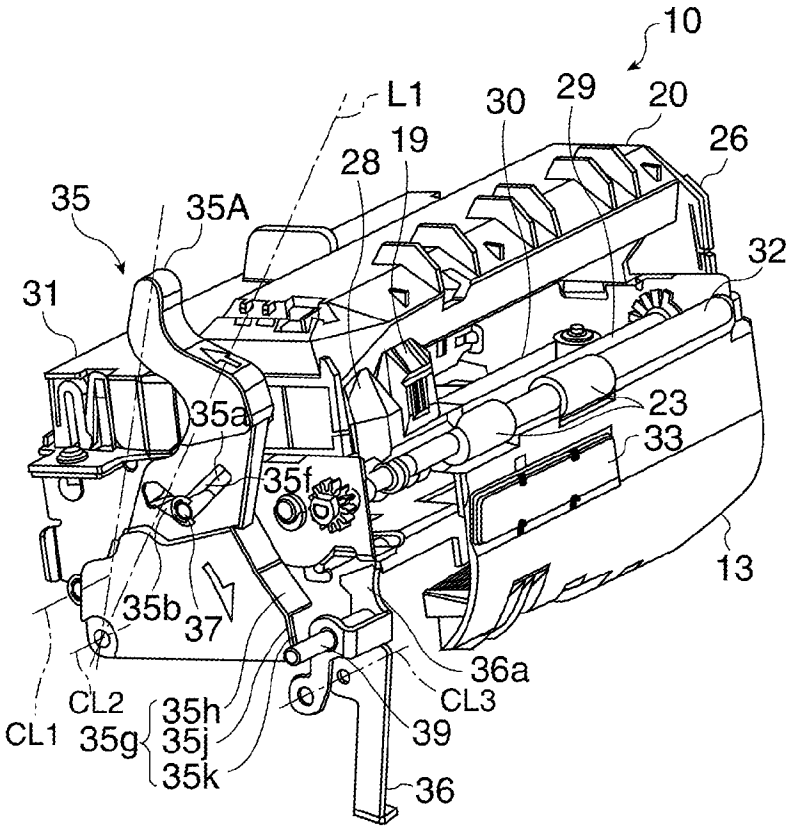
FIG. 7A illustrates opening the openable unit.

FIG. 6A and FIG. 6B, and FIG. 7A and FIG. 7B describe the operation opening the openable unit 10 shown in FIG. 2. FIG. 6A and FIG. 7A are oblique views from the right rear side of the openable unit 10, operating lever 35, and lock lever 36. FIG. 6B and FIG. 7B are right side views of the openable unit 10, operating lever 35, and lock lever 36.

When the openable unit 10 is in the closed position 10A, the engaging part 36*a* of the lock lever 36 is engaged from the top with the lock pin 38 fastened to the bottom of the head unit frame 26 as shown in FIG. 4, and the openable unit 10 is thereby locked in the closed position 10A by the lock lever 36. More specifically, when the openable unit 10 is in the closed position 10A, the lock lever 36 is in the locked position. The operating lever 35 is also at the first pivot position L1 at this time.

When the operator works the operating end 35A of the operating lever 35 at the first pivot position L1 and moves the operating lever 35 counterclockwise as seen in FIG. 4, the slide pin 37 first moves relative to the operating lever 35 along the first slope 35*c* of the first cam surface 35*b*, and the contact pin 39 moves along the third slope 35*h* of the second cam surface 35*g* relative to the operating lever 35. The openable unit 10 does not rotate while the slide pin 37 moves relative to the first slope 35*c*. More specifically, the openable unit 10 remains in the closed position 10A. When the contact pin 39 moves along the third slope 35*h*, the lock lever 36 moves clockwise in FIG. 4. More specifically, the contact pin 39 is pushed in the direction disengaging the lock pin 38 and engaging part 36*a*.

The lock pin 38 and engaging part 36*a* are thus disengaged as shown in FIG. 6B by the time the contact pin 39 reaches the bottom end of the third slope 35*h*, and the lock lever 36 separates from the openable unit 10 to the unlocked position. More specifically, the lock lever 36 rotates to the unlocked position releasing the openable unit 10 by the time the contact pin 39 reaches the bottom end of the third slope 35*h*. When the contact pin 39 reaches the bottom end of the third slope 35*h*, the slide pin 37 reaches the curved part 35*e* of the first cam surface 35*b*, and the operating lever 35 reaches the second pivot position L2.

When the operating lever 35 is then rotated further counterclockwise as seen in FIG. 4, the slide pin 37 moves along the second slope 35*d* relative to the operating lever 35. When the operating lever 35 moves along the second slope 35*d*, the openable unit 10 starts rotating counterclockwise as shown in FIG. 7A and FIG. 7B. When the slide pin 37 reaches the end of the second slope 35*d* and the operating lever 35 reaches the third pivot position L3, the openable unit 10 is in the open position as shown in FIG. 5. More specifically, when the operating lever 35 reaches the third pivot position L3, the openable unit 10 reaches the open position 10B. In addition, after reaching the bottom end of the third slope 35*h*, the contact pin 39 moves along the fourth slope 35*j* and fifth slope 35*k*, and separates from the operating lever 35.

When the openable unit 10 is in the open position 10B and the operating lever 35 is rotated clockwise in FIG. 4 from the third pivot position L3 toward the second pivot position L2, the slide pin 37 moves along the opposing cam surface 35*f* relative to the operating lever 35 and the openable unit 10 returns to the closed position 10A. At this time the contact pin 39 moves relative to the operating lever 35 along the fifth slope 35*k* and fourth slope 35*j*.

When the operating lever 35 rotates clockwise in FIG. 4 from the second pivot position L2 to the first pivot position L1, the openable unit 10 rotates relative to the operating lever 35 along the second cam surface 35*g* to the closed position 10A, and the engaging part 36*a* engages the lock pin 38. More specifically, the lock lever 36 rotates to the locked position. The slide pin 37 also moves relative to the operating lever 35 along the slope of the opposing cam surface 35*f* substantially parallel to the first slope 35*c*.

Rotation of the operating lever 35 from the first pivot position L1 to the second pivot position L2 is thus converted to movement of the lock lever 36 from the locked position to the unlocked position, and rotation of the operating lever 35 from the second pivot position L2 to the first pivot position L1 is converted to movement of the lock lever 36 from the unlocked position to the locked position, by the second cam surface 35*g* and contact pin 39.

In addition, rotation of the operating lever 35 from the second pivot position L2 to the third pivot position L3 is converted to rotation of the openable unit 10 from the closed position 10A to the open position 10B, and rotation of the operating lever 35 from the third pivot position L3 to the second pivot position L2 is converted to rotation of the openable unit 10 from the open position 10B to the closed position 10A, by the cam channel 35*a* and slide pin 37.

Main Effect of the Embodiment

As described above, the first pivot axis CL1 that is the pivot axis of the openable unit 10, and the second pivot axis CL2 that is the pivot axis of the operating lever 35, are located at different positions in this embodiment of the invention, and the openable unit 10 and operating lever 35 therefore rotate along different arcs. Because the cam channel 35*a* and slide pin 37 disposed therebetween therefore also rotate on different arcs, the opening angle (amount of rotation) of the openable unit 10 can be made greater than the operating angle (amount of rotation) of the operating lever 35 by appropriately configuring the cam channel 35*a* and slide pin 37. As a result, the openable unit 10 can be opened wide with a minimal operation.

Note that if the angle between the first slope 35*c* and second slope 35*d* is reduced, the opening angle of the openable unit 10 can be increased compared with the operating angle of the operating lever 35.

Furthermore, because the distance from the first pivot axis CL1 to the operating end 35A of the operating lever 35 is longer than the distance from the first pivot axis CL1 to the cam channel 35*a* in this embodiment of the invention, less movement is required to open the openable unit 10 compared with when the openable unit 10 is opened by directly holding a handle attached to the openable unit 10.

Furthermore, because the openable unit 10 does not open while the operating lever 35 rotates from the first pivot position L1 to the second pivot position L2, that is, until the lock lever 36 is disengaged from the locked position, the weight of the openable unit 10 does not act on the operating lever 35. The weight of the openable unit 10 and the counter force from the lock lever 36 therefore do not act simultaneously on the operating lever 35, and a large operating force is not required. The operating lever 35 can therefore be used to sequentially and continuously release and open the openable unit 10, and the operability of the operating lever 35 is good.

In this embodiment of the invention the distance from the second pivot axis CL2 to the operating end 35A of the operating lever 35 is longer than the distance from the second pivot axis CL2 to the cam channel 35*a* and longer than the distance from the second pivot axis CL2 to the second cam surface 35*g*. As a result, the operating lever 35 can be operated with little force to move the lock lever 36 in the unlocking direction and open the openable unit 10.

Other Embodiments

A cam channel 35*a* is formed in the operating lever 35, and the slide pin 37 is affixed to the head unit frame 26 in the embodiment described above, but a configuration in which a cam channel identical to the cam channel 35*a* is formed in the head unit frame 26, and the slide pin 37 is fixed to the operating lever 35, is also conceivable.

Furthermore, the second cam surface 35*g* is rendered to the operating lever 35, and the contact pin 39 is affixed to the lock lever 36, in the embodiment described above, but a configuration in which a cam surface identical to the second cam surface 35*g* is rendered on the operating lever 35, and the contact pin 39 is affixed to the operating lever 35, is also conceivable.

The second printhead 19 in the foregoing embodiment is a SIDM printhead, but the second printhead 19 could be a head for inkjet printing or a thermal head, for example.

The openable unit to which the invention is applied in the foregoing embodiment carries the second printhead 19, but the openable unit could be a unit that does not have a printhead.

Yet further, the invention is described using a check processing device 1 by way of example above, but can obviously also be applied to media processing devices that process media other than checks.

Although the present invention has been described in connection with the preferred embodiments thereof with reference to the accompanying drawings, it is to be noted that various changes and modifications will be apparent to those skilled in the art. Such changes and modifications are to be understood as included within the scope of the present invention as defined by the appended claims, unless they depart therefrom.

What is claimed is:

1. A media processing device comprising:

a main frame;

an openable unit that is attached to the main frame pivotably on a first pivot axis through a range from a closed position to an open position;

a media transportation path that is formed between the openable unit in the closed position and the main frame for conveying a recording medium, and becomes open when the openable unit opens toward the open position;

a lock member that is attached to the main frame movably between a locked position where it locks the openable unit in the closed position, and an unlocked position where the lock is released;

an operating lever that can rotate relative to the main frame on a second pivot axis that is parallel to the first pivot axis at a different position than the first pivot axis, wherein the operating lever pivots about the second pivot axis at differing pivot positions along the operating lever through a range from a first pivot position through a second pivot position to a third pivot position; and a first cam mechanism that is disposed between the operating lever and the openable unit, converts rotation of the operating lever from the second pivot position to the third pivot position to rotation of the openable unit from the closed position to the open position, and converts rotation of the operating lever from the third pivot position to the second pivot position to rotation of the openable unit from the open position to the closed position.

2. The media processing device described in claim 1, further comprising:

a second cam mechanism that is disposed between the operating lever and the lock member, converts rotation of the operating lever from the first pivot position to the second pivot position to movement of the lock member from the locked position to the unlocked position, and converts rotation of the operating lever from the second pivot position to the first pivot position to movement of the lock member from the unlocked position to the locked position.

3. The media processing device described in claim 2, wherein:

the first cam mechanism has a cam channel formed in the operating lever, and a slide pin that can slide in the cam channel and is attached to the openable unit, the cam channel has a first cam channel part that extends in the direction of an arc centered on the second pivot axis, and a second cam channel part that curves and extends to the outside radially to the arc from the end of the first cam channel part in the closing direction of the openable unit; and while the operating lever rotates from the first pivot position to the second pivot position, the slide pin slides along the first cam channel part and the openable unit is held in the closed position, and when the operating lever rotates from the second pivot position to the third pivot position, the slide pin slides along the second cam channel part and rotates around the first pivot axis, and the openable unit rotates to the open position.

4. The media processing device described in claim 3, wherein:

the second cam mechanism includes a cam surface formed on the operating lever, and a pin attached to the lock member; and while the operating lever rotates from the first pivot position to the second pivot position, the pin is pushed in the direction moving the lock member to the unlocked position while sliding along the cam surface.

5. The media processing device described in claim 4, wherein:

the operating lever has an operating end for operating the operating lever; and the distance from the second pivot axis to the operating end is longer than the distance from the second pivot axis to the cam channel, and longer than the distance from the second pivot axis to the cam surface.

6. The media processing device described in claim 1, wherein:

the first pivot position is the position of the operating lever when the openable unit is in the closed position and the lock member is in the locked position;

the second pivot position is the position of the operating lever when the lock member is in the unlocked position; and the third pivot position is the position of the operating lever when the openable unit is in the open position.

* * * * *